US008646584B2

(12) United States Patent
Moussatche et al.

(10) Patent No.: US 8,646,584 B2
(45) Date of Patent: Feb. 11, 2014

(54) REINFORCED EXTRUDED TUBING FOR TELESCOPIC HANDLE FOR TROLLEY-TYPE CARRY CASE AND CARRY CASE INCORPORATING SAME

(75) Inventors: Michel H. Moussatche, Kew Gardens, NY (US); Joseph Conti, Astoria, NY (US); Georgene Rada, Northport, NY (US); Richard J. Krulik, Northport, NY (US); Wu-Chen Chuan, Hsin Chuang (TW); Fu-Kuei Chang, Hsin Chuang (TW)

(73) Assignee: Briggs & Riley Travelware, LLC, Hauppauge, NY (US)

( * ) Notice: Subject to any disclaimer, the term of this patent is extended or adjusted under 35 U.S.C. 154(b) by 201 days.

(21) Appl. No.: 12/930,973

(22) Filed: Jan. 20, 2011
(Under 37 CFR 1.47)

(65) Prior Publication Data

US 2012/0103740 A1 May 3, 2012

Related U.S. Application Data

(60) Provisional application No. 61/297,153, filed on Jan. 21, 2010.

(51) Int. Cl.
*A45C 5/00* (2006.01)
*A45C 13/26* (2006.01)

(52) U.S. Cl.
USPC ..... 190/115; 16/113.1

(58) Field of Classification Search
USPC ..... 190/39, 115; 16/113.1, 114.1, 129; 403/362
See application file for complete search history.

(56) References Cited

U.S. PATENT DOCUMENTS

| | | | | |
|---|---|---|---|---|
| 813,918 | A | 2/1906 | Schmitz | |
| 1,306,778 | A * | 6/1919 | Sadlovsky | 16/114.1 |
| 3,115,227 | A * | 12/1963 | Shanok et al. | 16/114.1 |
| 3,931,968 | A * | 1/1976 | Hedberg | 473/552 |
| 4,052,522 | A | 10/1977 | Narita | |
| 4,598,002 | A | 7/1986 | Kimura | |
| 4,654,238 | A | 3/1987 | Yamazaki et al. | |
| 4,668,543 | A | 5/1987 | Schlenz | |
| 4,708,898 | A | 11/1987 | Gommier et al. | |
| 4,869,937 | A | 9/1989 | Nagata et al. | |

(Continued)

FOREIGN PATENT DOCUMENTS

| | | |
|---|---|---|
| DE | 19800508 | 7/1997 |
| GB | 190625528 | 7/1907 |

(Continued)

*Primary Examiner* — Sue A Weaver
(74) *Attorney, Agent, or Firm* — Scully, Scott, Murphy & Presser, P.C.

(57) ABSTRACT

Lightweight reinforced modular tubes of extruded plastic material are provided for the first stage of a trolley-type carry case, in combination with a locking mechanism, which facilitates effective extension and collapse of a multi-telescopic handle system. The tubes are made of extruded plastic material and include a pair of opposed metal strips having appropriately spaced and dimensioned apertures for reception of spring loaded locking pins of the telescopic system. The metal strips are respectively retained in position by a pair of radially extending elongated flange members which overlap marginal positions of the strips. The tubes and the metal strips can easily and quickly be cut to size to fit any size carry case. While the metal insert strips are preferably made of aluminum, any material stronger than the extruded plastic of the first stage tube can be used, i.e., steel, nylon, PVC, polyethylene, polycarbonate, or the like.

12 Claims, 7 Drawing Sheets

(56) References Cited

U.S. PATENT DOCUMENTS

| | | | | |
|---|---|---|---|---|
| 4,915,991 | A | 4/1990 | Rabe | |
| 4,965,103 | A | 10/1990 | Roberts et al. | |
| 4,991,352 | A | 2/1991 | Hyer | |
| 5,249,881 | A | 10/1993 | Austin, Jr. et al. | |
| 5,399,394 | A | 3/1995 | Zoller | |
| 5,419,863 | A | 5/1995 | Henderson | |
| 5,500,981 | A * | 3/1996 | Ho | 16/113.1 |
| 5,619,448 | A * | 4/1997 | Lin | 365/185.03 |
| 5,644,816 | A | 7/1997 | Chou | |
| 5,664,608 | A | 9/1997 | Kawasaki | |
| 5,682,925 | A | 11/1997 | Seckel | |
| 5,787,588 | A | 8/1998 | Tisbo et al. | |
| 5,864,921 | A * | 2/1999 | Chou | 16/405 |
| 5,884,960 | A | 3/1999 | Wycech | |
| 5,888,600 | A | 3/1999 | Wycech | |
| 5,909,760 | A * | 6/1999 | Tsai | 16/429 |
| 6,039,661 | A | 3/2000 | Christian et al. | |
| 6,122,800 | A * | 9/2000 | Cheng | 16/113.1 |
| 6,165,588 | A | 12/2000 | Wycech | |
| 6,425,162 | B1 * | 7/2002 | Wang | 16/113.1 |
| 6,739,599 | B1 | 5/2004 | Uchimura et al. | |
| 7,322,379 | B2 | 1/2008 | Evans | |
| 2002/0006523 | A1 | 1/2002 | Obeshaw | |
| 2004/0188963 | A1 * | 9/2004 | Gant | 280/47.24 |
| 2006/0225981 | A1 * | 10/2006 | Lin | 190/115 |
| 2007/0205217 | A1 | 9/2007 | Scott | |
| 2008/0053771 | A1 * | 3/2008 | Wu | 190/115 |
| 2008/0168627 | A1 * | 7/2008 | Lai | 16/429 |

FOREIGN PATENT DOCUMENTS

| | | |
|---|---|---|
| GB | 629974 | 10/1949 |
| GB | 778614 | 7/1957 |
| GB | 2 441 595 | 3/2008 |
| WO | WO2009/121972 | 10/2009 |

* cited by examiner

FIG.1
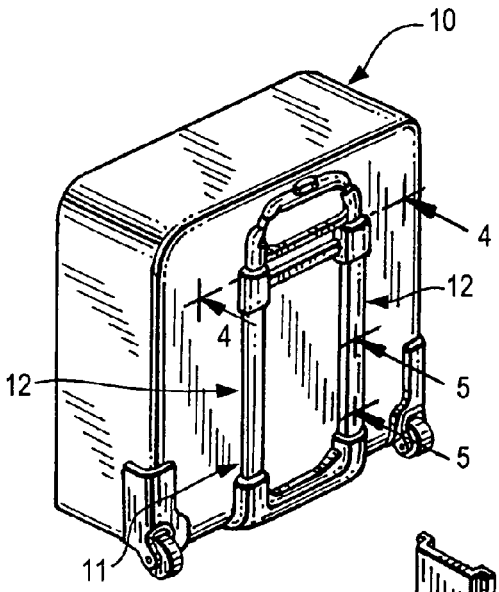
FIG.8
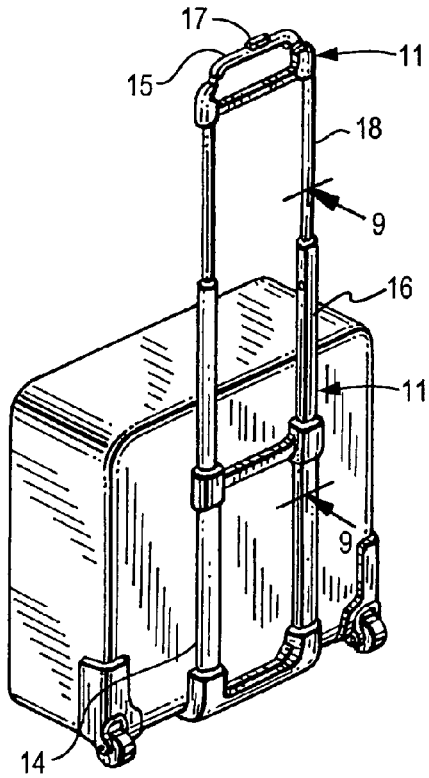
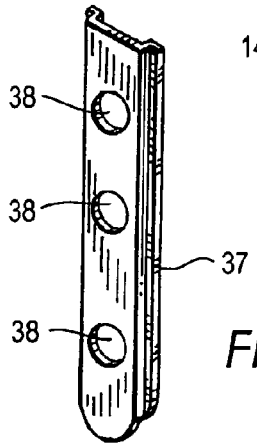
FIG.10

REINFORCED EXTRUDED TUBING FOR TELESCOPIC HANDLE FOR TROLLEY-TYPE CARRY CASE AND CARRY CASE INCORPORATING SAME

CROSS-REFERENCE TO RELATED APPLICATIONS

This application claims priority to U.S. Provisional Application No. 61/297,153, filed Jan. 21, 2010, the disclosure of which is incorporated herein by reference and made a part of this application.

BACKGROUND OF THE INVENTION

1. Field of the Invention

The present invention relates to any lightweight reinforced extruded tubing for telescopic handles for trolley-type carry cases, wherein the first stage tube is reinforced by metal strips having apertures which are dimensioned and positioned to receive the spring biased locking pins of a multi-stage locking mechanism.

2. Description of the Related Art

Present day tube technology, particularly technology for the first (i.e., lowermost) stage of telescopic handles for carry cases has advanced in several stages. The following is a brief history of the developments of advancements in such tube technology.

First Generation

In general, the strength requirements of the pair of first stage tubular members which form the basis for a telescopic handle have always required a pair of tubes which are of sufficient strength to withstand the forces generally applied to them, not only during the upward and downward telescopic extension and collapsing action, but also while traveling with the carry case, particularly over rough terrain, stairways and the like. Additionally, when the first stage tubes are outside of the case, it is desirable that they match the case. For this reason, particularly for such applications, the outside of the tube was always made of a plastic material which matched the case.

In the past, the pair of tubular members which formed the first stage of the telescopic mechanisms for such applications were originally comprised of a pair of metal tubes, each tube being surrounded by a plastic extruded polyvinyl chloride (i.e., PVC) tube assembled to the metal tube so as to appear like plastic tubes to match the carry case. The inner metal tube provided the strength for the spring loaded pins that entered the apertures in the metal tube from the telescopic second and third stage handles. In particular, the metal tube was required in order to provide strength for reception of the pins into the apertures from the second and third stage tubes, since a plastic tube with such apertures would normally not have the strength to receive the pins or to support the forces applied thereto during use. Over time, such apertures, if provided in the plastic tube, would become elongated and worn. Furthermore, the metal tubes provided the strength required for traveling with the case; i.e., bending, tension, compression and shock loads. However, the metal tubes added unwanted additional cost and excessive weight to the entire case.

Second Generation

Subsequently an improved version of the first stage tubes was provided by simply individually molding a pair of plastic tubes of ABS (i.e., Acrylonitrile-Butadiene-Styrene) in individual molds. The individually molded tubes were stronger than the extruded tubes of the first generation. However they also needed to be reinforced by a metal tube inserted into the plastic tube as in the first generation. These metal tubes were also capable of carrying the loads from the spring loaded pins provided by the second and third stage telescoping tubes. As in the first generation tubes, the metal tubes also added strength and weight to the tube, and the carry case, as well.

One disadvantage however, of the molded tubes is that they needed to be custom molded for individually sized carry cases, thus increasing their production costs. For example, each pair of first stage tubes required an individualized molding process for each size carry case. This is in sharp contrast with the prior generation of extruded tubes which were simply cut to size for each style and size of carry case. Accordingly, it would appear that extruded tubes always provided a significant advantage over molded tubes. However, notwithstanding that fact, the present invention can be used with individually molded tubes as well.

SUMMARY OF THE INVENTION

A tube for a first stage of a telescopic handle system for a trolley-type carry case is disclosed, which comprises an elongated tubular member, and at least a pair of opposed radially inwardly extending members extending from the inner surface of the tubular member, each said inwardly extending member being comprised of a radially inwardly extending member having a generally circumferential flange member extending from the free end thereof and each said flange member facing the other so as to form a pair of opposed flange members which define a space therebetween for reception of an elongated reinforcement strip.

At least one elongated reinforcement strip is positioned between the flange members and retained in position against the inner surface of the elongated tubular member, the elongated reinforcement strip being of a material which adds strength to the elongated tubular member. The elongated reinforcement strip has a plurality of apertures dimensionally and relatively spaced for reception of spring biased locking pins associated with a locking device for retaining respective associated stages of a telescopic handle in either the withdrawn or the extended position when the pins enter predetermined respective apertures in said reinforcement strip.

The tubular member for the first stage of a telescopic handle assembly for a trolley-type carry case, said generally tubular member is made of an extruded plastic material and defines a generally central elongated tubular opening, the tubular member including within the generally tubular opening, a pair of opposed reinforcement strips extending generally along the length thereof. Each reinforcement strip is retained in position by retaining members positioned thereallong and adjacent thereto, the reinforcement strips being of a material of strength generally greater than the strength of the material of the extruded plastic tubular member. Each said reinforcement strip has a plurality of apertures of predetermined size and relative positions for respective reception of spring biased pins associated with respective second and third stage sections of the telescopic handle assembly for respective retention of the handle assembly in the respective collapsed and extended positions.

The extruded plastic tubular member preferably comprises a plurality of radial plastic ribs extending inwardly of the inner surface to provide structural support to the tubular member. The handle system comprises a pair of said first stage tubular members.

A locking system is provided to extend and lock second and third stage sections in selected portions.

The third stage tubes are connected by a gripping handle and the locking system includes a release button in the gripping handle, the release button being connected to respective cables and spring biased pins adapted to selectively lock and release the second and third stage tubes in selected positions. Preferably, the second and third stage tubes are aluminum.

The first stage extruded tubes include a plurality of inwardly extending radial members to provide reinforcement to the tubes. Further, the extruded tubes are polyvinyl chloride and the metal strips and aluminum insert reinforcement strips. The aluminum reinforcement insert strips preferably include top and bottom end portions which are bent over the respective edges of said extruded tubes to retain the strips in position in the tube.

A telescopic handle system for a trolley-type carry-case is disclosed, which comprises at least a first stage extruded plastic tubular member, the extruded plastic tubular member defining a generally central tubular opening having an inner tubular surface, the tubular member has positioned on the inner surface of the inner opening, a pair of generally opposed reinforcement strips made of a material of strength greater than the material of said tubular member. Each reinforcement strip has a generally radially extending retention member positioned along each side thereof to retain the reinforcement strip in position on the inner surface of the tubular member. Each reinforcement strip has a plurality of apertures of predetermined size and relative locations for selective reception of spring biased pins associated with a respective second and third stage members of the telescoping handle system.

A trolley-type carry case having a three stage telescopic handle system is disclosed, which comprises a container for reception and retention of selected articles, and a telescopic handle system attached to the container. The handle system comprises at least a first stage extruded plastic tubular member, the extruded plastic tubular member defining a generally central tubular opening having an inner tubular surface. The tubular member has positioned on the inner surface of the inner opening, a pair of generally opposed reinforcement strips made of a material of strength greater than the material of the tubular member. Each reinforcement strip has a generally radially extending retention member positioned along each side thereof to retain the reinforcement strip in position adjacent the inner surface of the tubular member. Each said reinforcement strip has a plurality of apertures of predetermined size and relative locations for reception of spring biased pins associated with a respective second and third stage members of said telescoping handle system. The container is preferably an article of luggage.

The Present Invention: Third Generation: Back to Extrusions

The present invention relates to a first stage of a telescoping handle for a carry case having a combination of a pair of extruded plastic (i.e., ABS, or other extrudable plastic) tubes which include elongated lengthwise ribs, some of which in combination, form channels which are dimensioned to substantially snuggly receive lengthwise insert strips of a material having greater strength and wear resistance than that of the tube. In the preferred embodiment, the insert strips extend over the same length as the extruded plastic tube, or are slightly longer to permit binding the top portions over to retain the insert strip in position. In another embodiment, the insert strips can be of length less than that of the tube.

While the insert strips can be of any material of greater strength and wear resistance than the extruded plastic tube, a metal, such as aluminum or cold rolled steel can be used. Presently aluminum is preferred. Any material of sufficient strength can be used, as will be described hereinbelow.

In particular, the metal insert strips contain apertures of predetermined dimension and relative locations, for reception of the spring loaded locking pins of the telescoping mechanism, and they are therefore adapted to withstand the loads provided by the spring loaded pins when they enter the apertures in the metal strips, as well as when the carry case is wheeled from place to place. Accordingly, the combination of the extruded plastic tubes and the metal insert strips provide stability for accommodating carry cases of all sizes.

Also, the metal strips engage the second stage tube as it enters and exits the first stage, to thereby provide guidance for the second stage, and wear resistance from the periodic rubbing of the second stage when it slidably enters the first stage tube.

Additionally, while the plastic extrusion of the first stage has an appearance which blends with the remaining components of the carry case, the stronger metal insert strips which help to carry the loads are not apparent to the eye of the observer and do not detract from the aesthetic appearance of the telescoping handle with respect to the bag.

The channel ribs, as well as the remaining inwardly extending radial ribs of the extruded tube also add strength to the tube. Optionally, the radial ribs can also be made long enough to provide additional guidance for the second stage tube as it enters the first (or lowermost stage) as will be described in further detail.

The tube of the present invention is considered to be "modular" because it can be extruded in any length and cut to specific sizes, as needed, along with the same size metal inserts. This feature is in contrast to the prior art tubes, where individual molds had to be made for each different length tube which respectively applied to different types of carry cases.

In summary, the extruded tube is strengthened by:

a) The plurality of internal radially extending ribs;

b) The inserted strips of metal, which can be either aluminum or cold rolled steel, or any strong material. Nylon, polyvinyl chloride (PVC), polyethylene or polycarbonate type materials are also contemplated for the insert strips, provided they are of sufficient strength to enhance the strength of the extended tubes. Presently, aluminum is preferred.

c) The insert strips of metal also provide sliding contact with the second stage tube as it enters and exits the first stage tube, thereby guiding the second stage tube with a relatively wear-resistant surface.

In one embodiment, each strip of metal is approximately 1 mm (i.e., millimeters) in thickness and 1.5 cm (i.e., centimeters) in width. They fit snuggly within each channel which is formed by a pair of molded ribs. Preferably the insert strips are made slightly longer than the tubes so as to facilitate folding an end portion over the top and bottom end faces of the tube to retain them in position, longitudinally as shown in FIG. 7.

The metal strips in effect, provide an extra reinforcing factor, since most bending forces applied to the metal strips will generally be about an axis perpendicular to the metal strip when moving the carry case over uneven terrain. In two stage applications, one reinforcement insert strip may be used.

BRIEF DESCRIPTION OF THE DRAWINGS

Preferred embodiments of the invention are described hereinbelow with reference to the drawings, wherein:

FIG. 1 is a top perspective view of a trolley-type carry case, showing the telescoping handle of the present invention in its collapsed condition;

FIG. 8 is a top perspective view of the trolley-type carry case of FIG. 1, with telescopic handle of the present invention shown in the fully extended condition;

FIG. 10 is a perspective view of an alternative embodiment of the reinforcing metal strip of the invention, used for the locking pins, the metal strip being shorter in length and intended for use with tubes of greater strength, by virtue of utilizing either a plastic material of greater strength for the extruded tube, or a tube wall of greater thickness, or a combination of both features, said metal strip being used in combination with a similar short metal strip positioned opposite the first strip to provide the same pattern of apertures for the locking pins as is provided by the larger strips.

DETAILED DESCRIPTION OF THE PREFERRED EMBODIMENTS

Referring initially to FIG. 1, there is shown a perspective view showing the handle of the present invention in its collapsed condition.

Figure 2:
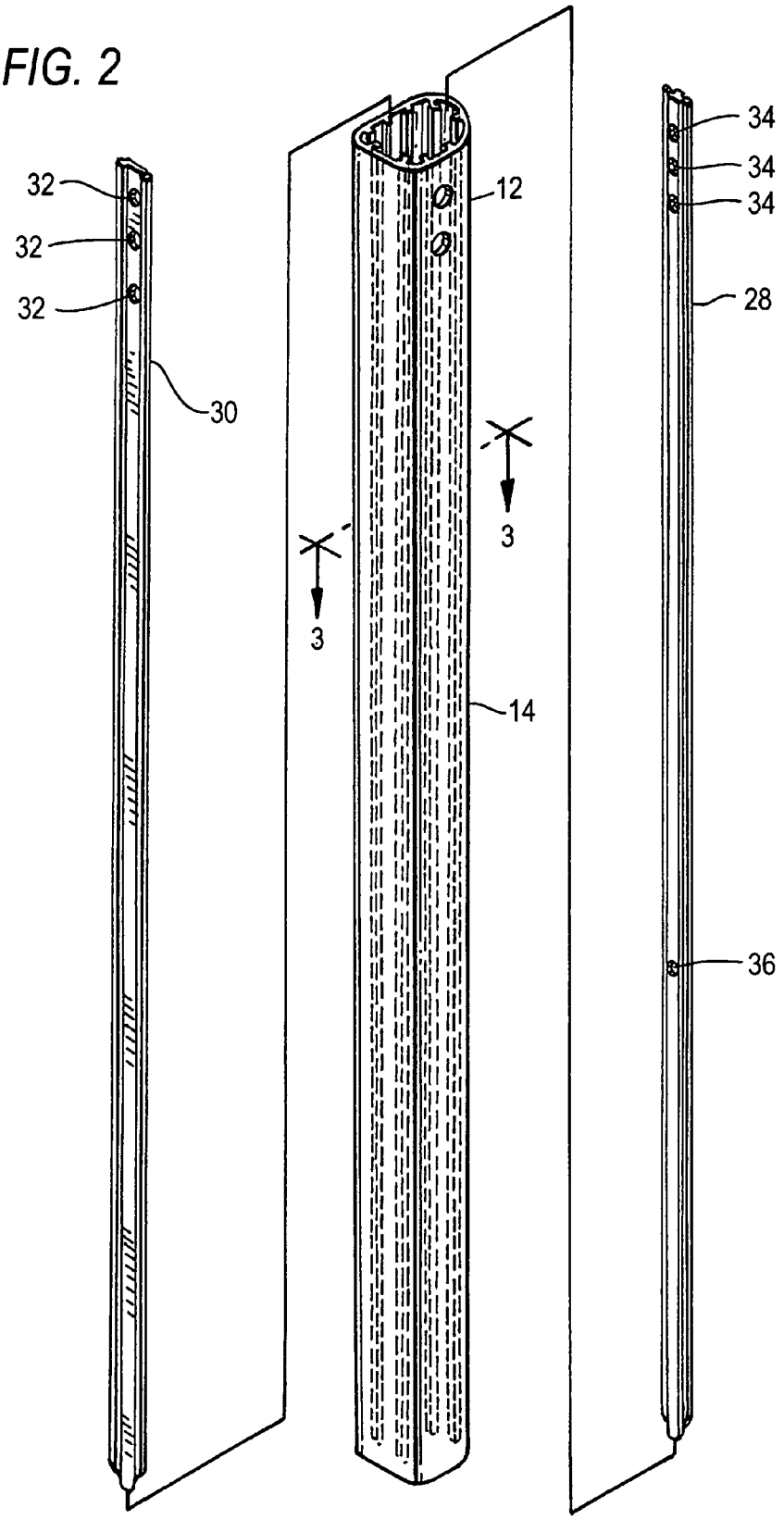
FIG. 2 is an enlarged view with parts separated for illustration purposes, of an extruded plastic tube that retains two metal strips that extend downwardly along each side of the plastic tube for added strength, each metal strip having apertures dimensioned and positioned to receive spring loaded locking pins therein when the handle sections are extended for use.

FIG. 2 shows an enlarged view of the first stage extruded plastic tube of the handle of FIG. 1, which retains two opposed metal strips which extend downwardly along each opposed inner side of the extruded plastic tube for added strength. Each metal strip has apertures for reception of locking pins which become aligned therewith. Moreover, the extruded plastic tube includes radially inwardly extending ribs for added strength.

Figure 3:
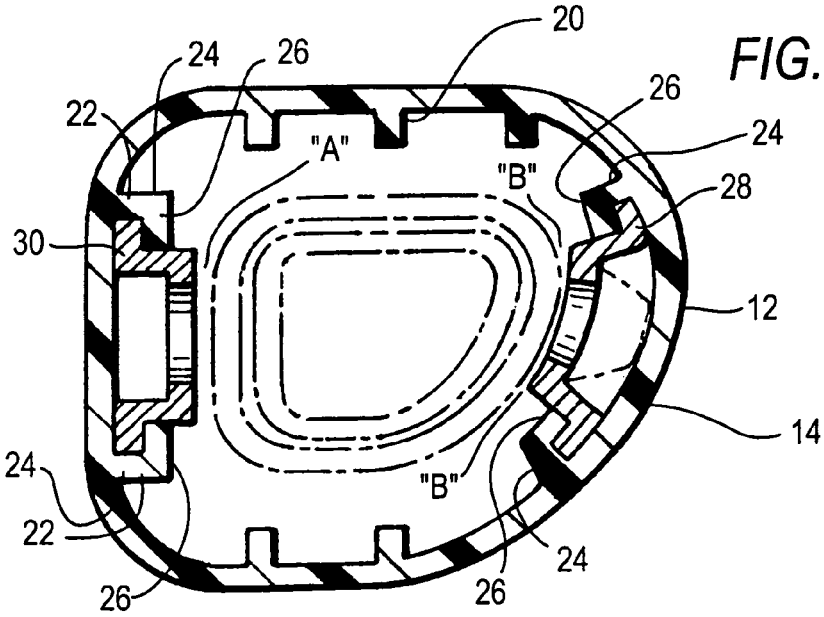
FIG. 3 is an enlarged cross-sectional view taken along lines 3-3 of FIG. 2, showing the two metal strips of FIG. 2 in position, and also showing the two telescoping upper second and third stage handle tubes in phantom which are generally made of aluminum; this Fig. also illustrates the guiding function of the metal inserts with respect to the second stage tube as it enters and exits the first stage tube while contacting the first stage tube.

FIG. 3 is an enlarged cross sectional view, taken along lines 3-3 of FIG. 2. This enlarged view shows the two metal strips in place, as well as the two telescopic handle second and third stage 16, 18 tubes in phantom. As the second and third stage aluminum tubes 16, 18 enter and exit the first stage tube 12, the second stage tube is guided by metal inserts 28, 30 as contact is made with the wear resistant surfaces of the metal strips 28, 30. This contact is made in the areas marked "A" and "B" in FIG. 3 which show the spaces as somewhat exaggerated, between the second stage tube and the metal insert strips. However, in reality these spaces are minimal, and provide continuous guidance for the second stage tube as it enters and exits the first stage tube. The metal insert strips provide lasting wear resistant surfaces as compared to the inner components of the extruded plastic tube.

Figure 4:
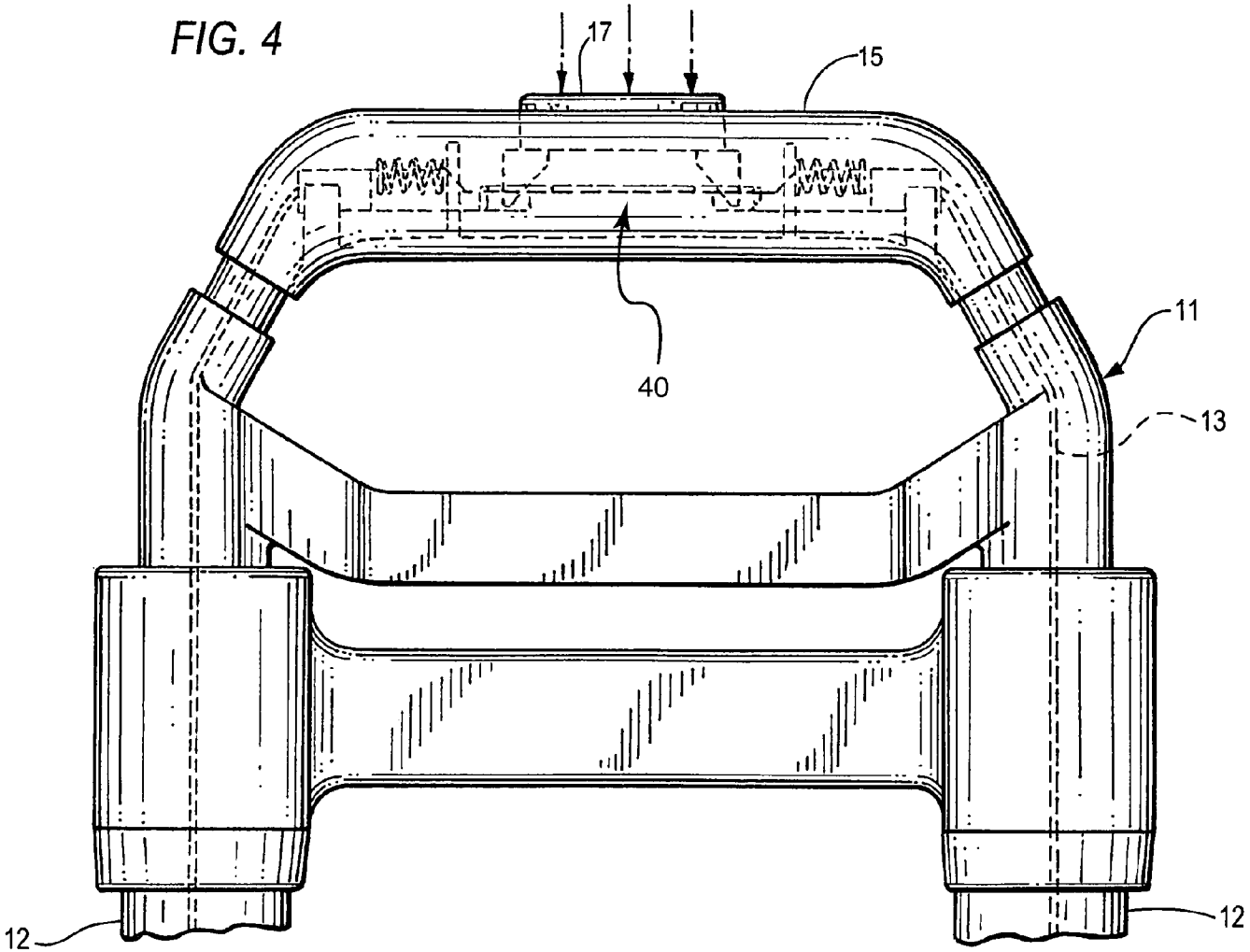
FIG. 4 is an elevational view of the gripping handle portion of the telescopic handle, taken along lines 4-4 of FIG. 1, and showing how by pressing the button at the top, the cables which extend downwardly along each side of the telescopic tubes move upwardly to release their respective spring loaded locking pins.

FIG. 4 is an elevational view of the handle portion, taken along lines 4-4 of FIG. 1. This view shows how by pressing the button at the top will pull on the cables that extend downwardly along each side of the telescopic tubes to apply tension to the cables to withdraw their respective spring loaded release pins as shown.

Figure 5:
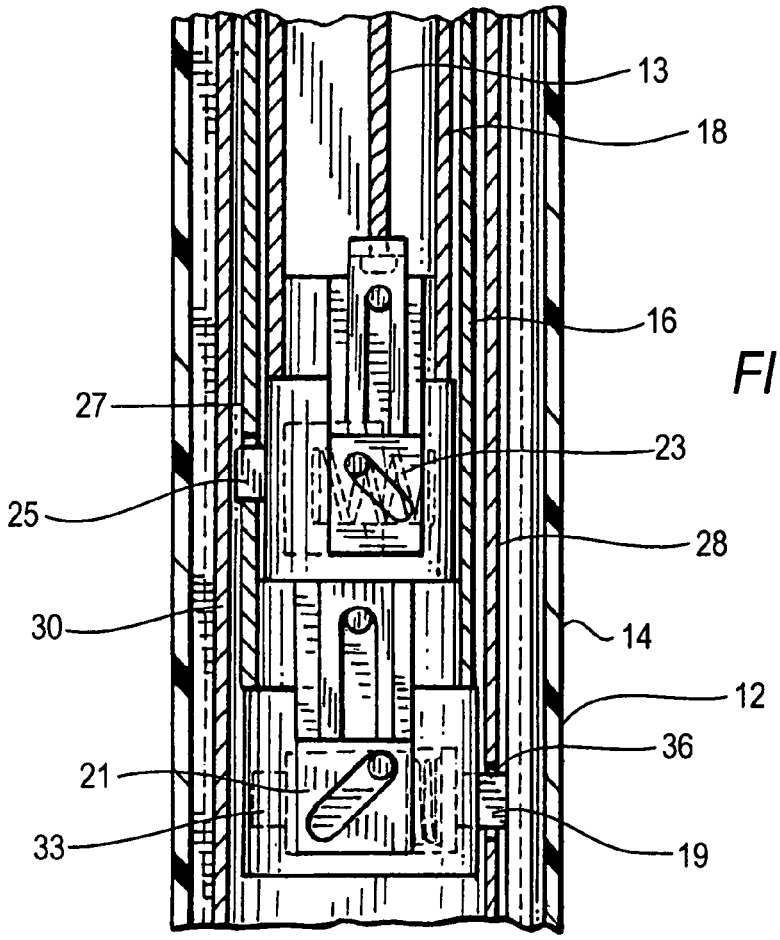
FIG. 5 is a cross-sectional view, taken along lines 5-5 of FIG. 1, and illustrating the locking mechanism of the telescopic handle according to the present invention in the collapsed condition.

FIG. 5 is a partial cross-sectional view, taken along lines 5-5 of FIG. 1. In this view all of the parts of the telescopic handle are in their collapsed and locked position. When the innermost (i.e., third stage) tube is fully withdrawn, it will press downwardly against on the bottom locking stopper in the second stage telescoping tube. When this takes place, the secondary pin locks into the outer metal strip, pulling into its housing the primary pin. This view also shows the stopper at the bottom of the innermost tube, with its locking pin engaging the left side of the second telescopic tube.

Figure 6:
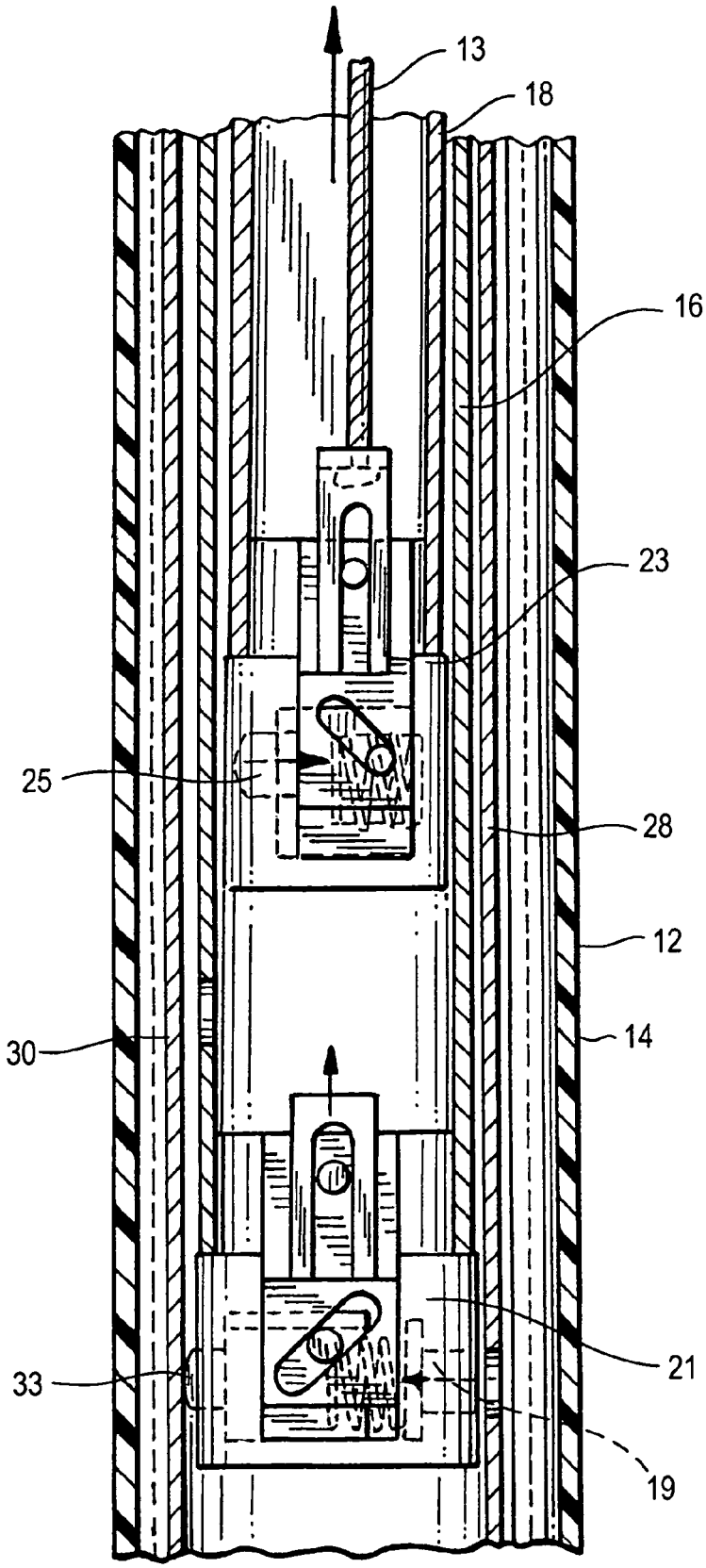
FIG. 6 is a cross-sectional view of the mechanism of FIG. 5, illustrating movement of the initial locking mechanism and the third (or innermost) tube, when the release button located at the top of the gripping is depressed and the third tube is pulled upwardly.

FIG. 6 shows the movement of the locking mechanism when the release button on the handle is pressed to provide camming action to pull the cable upwardly, to in turn permit the user to pull the third stage (i.e., innermost) tube upwardly. The innermost third stage locking pin of the third stage tube is released through the cable action, and the innermost telescopic tube starts moving up manually. This view also shows that when this movement takes place, the secondary locking pin (i.e., the lower locking device) moves inwardly and unlocks the second telescopic tube, so that the second telescopic tube is released for upward manual movement with the second stage in tandem with the third stage tube when the locking pin associated with the third stage enters the aperture of the second stage, the second stage moves upwardly with the third stage.

Figure 7:
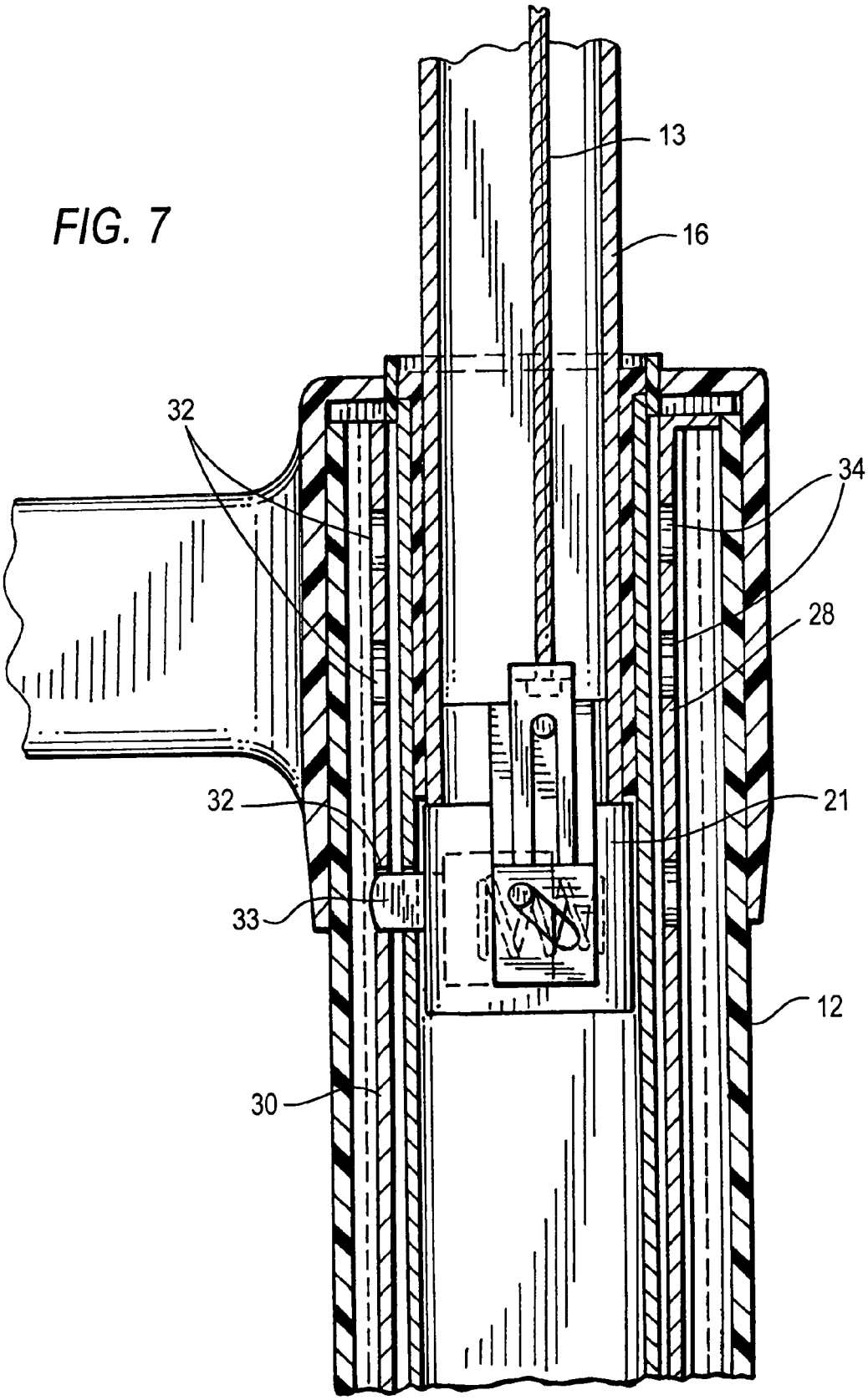
FIG. 7 is a cross-sectional view of the locking mechanism, showing the third (or innermost) tube approaching the next (or middle) locking position.

FIG. 7 shows the innermost third stage tube reaching the next locking position. When this movement takes place, the locking pin of the innermost third stage tube passes through the second stage tube wall and then through the aperture in the inner metal strengthening strip positioned in place on the first stage (i.e., lowermost) tube. At this point the handle is at the middle height position.

FIG. 8 is a top perspective view of the trolley-type carry case of FIG. 1, with the telescoping handle in the fully extended and locked condition.

Figure 9:
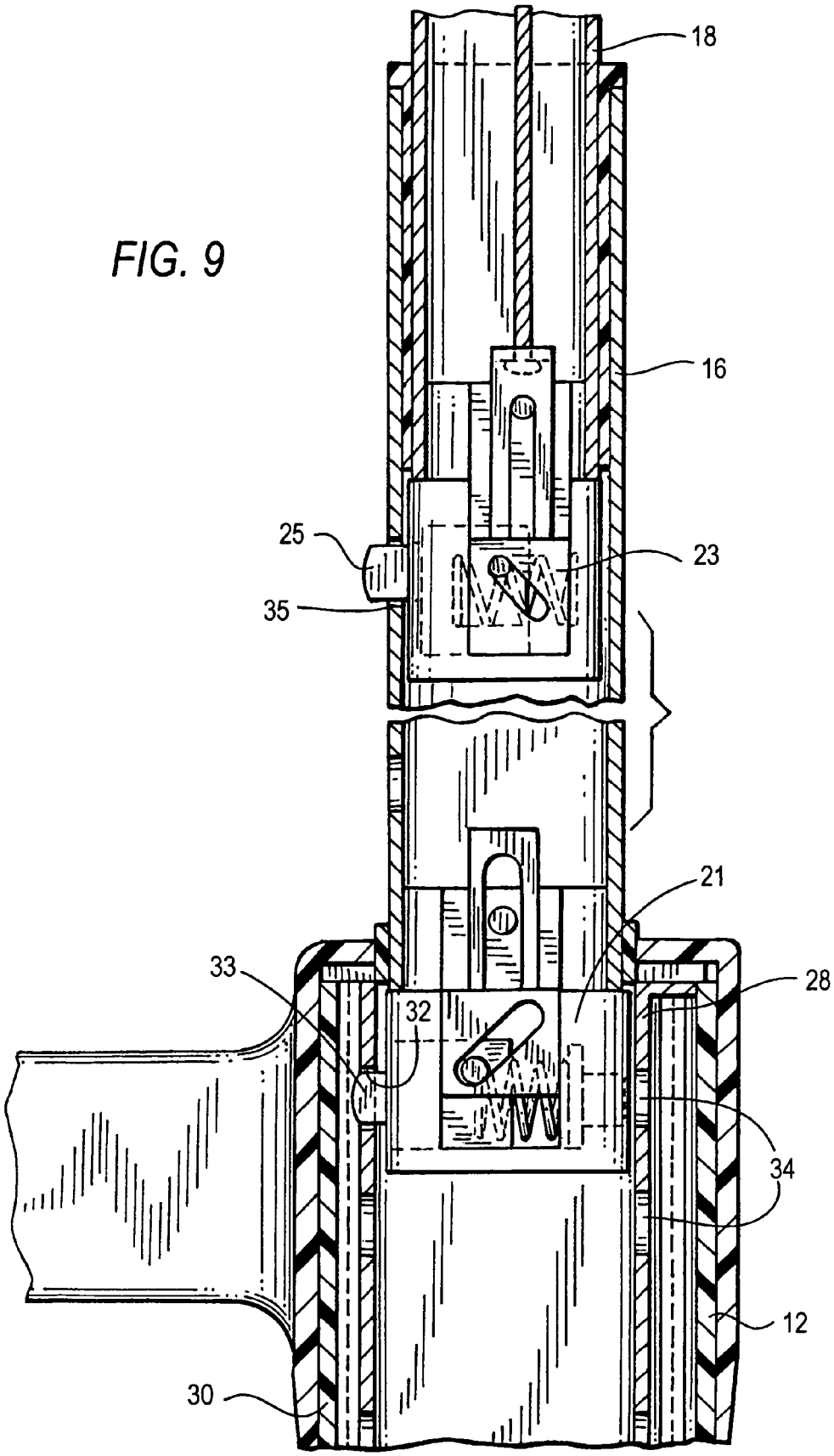
FIG. 9 is a cross-sectional view taken along lines 9-9 of FIG. 8, and illustrating the locking pin mechanism when the handle is in the fully extended condition, with the second and third stage tubes fully withdrawn from the first tube.

FIG. 9 is a cross sectional view, taken along lines 9-9 of FIG. 8, and illustrating the locking mechanism attached to the innermost (i.e., third stage) tube, when locked into the second telescopic tube. At the bottom of the second telescopic tube, it can be seen that its primary locking pin 33 has moved to the left, thereby locking into the aperture 32 of the inner, or left metal strip attached to the first stage tube. At this point the handle is at its fully extended height.

FIG. 10 is a perspective view of an alternative embodiment of the invention, showing a short metal strip used in place of the long metal strips for reception of the locking pins. This strip could be used in combination with a similar opposed short metal strip in a first stage plastic housing tube made of a higher strength plastic, or having a greater wall thickness which would obviate the need for the additional strength provided by the longer metal strips.

Referring again to FIGS. 1 and 8, the trolley-type carry case 10 includes telescopic handle 11 having a pair of parallel tubes, each comprised of three stages, stage 1, designated as 14, stage 2, designated as 16, and stage 3, designated as 18.

The present invention relates primarily to the tube 12 of the first stage 14, which is made of an extruded plastic outer tubing 14 shown in cross-section in FIG. 3, and having radially inwardly extending internal ribs 20, 22 and 24. Ribs 20 provide reinforcement to the tube 12. Ribs 22 and 24 each include an inward radial extension 24, as well as a circumferential extension 26. Ribs 22 are therefore configured in this manner to retain metal reinforcing strips 28, 30, which are preferably made of aluminum, but which can be of any alternative material such as cold rolled steel, or high strength plastic, such as nylon, polyvinyl chloride (i.e., PVC), polyethylene, polycarbonate, or the like. Furthermore, as can be seen in the cross-sectional view of FIG. 3, metal strip 30 differs somewhat in cross-section from metal strip 28 to accommodate the shape of extruded tube 12; however both strips 28, 30 have a generally "hat-like" cross-sectional shape.

It can be appreciated that extruded tube 12 is clearly reinforced by metal strips 28, 30 which also include apertures 32, 34, 36 respectively (see FIG. 2) for reception of the spring loaded locking pins of the telescoping mechanism in the extended, intermediate, and collapsed conditions, respectively, as can be seen in the cross-sectional views of FIGS. 4-9. It can also be appreciated that the reinforced lightweight extruded plastic tubes of the present invention now make it possible (via the metal strips 28, 30) to provide the higher strength apertures for reception of the spring loaded locking pins 19, 25, 33.

FIG. 10 illustrates an alternative embodiment 37 of the metal strips 28, 30 of FIG. 2, which can be used with extruded or molded plastic tubes made of high strength plastic. In such case, the tube reinforcing feature of the metal strips will not be needed. However, the metal pin reception apertures 38 of strip 37 are provided to receive the locking pins 25, 33 in the same manner as the longer metal strips of FIG. 2. Two similar shorter metal strips (one not shown) can be provided on the opposite sides of the plastic tube to provide locking apertures in the same locations as shown with the longer metal strips 30, 36 of FIG. 2.

Referring again to FIGS. 4-7, the locking mechanism for the three stage telescoping handle is illustrated.

The complete telescopic handle 11 is comprised of parallel spaced apart three stage telescoping sections 14, 16, 18, connected at their upper ends by transverse gripping handle 15, which houses the controlling mechanism 40 for releasing the telescoping mechanism which is activated by depressing button 17 on gripping handle 15, for example, when the three stage telescoping handle is in the collapsed condition as shown in FIG. 1. In this condition the locking mechanism at the base of the first stage 14 is as shown in FIG. 5, i.e., with the locking pin 19 of lower locking mechanism 21 positioned in aperture 36 of metal strip 28, while the locking pin 25 of upper locking mechanism 23 is positioned in the aperture 27 of the second stage tube 16.

In FIGS. 6-9, the button 17 of FIGS. 4 and 8 has been depressed, the dual action camming device in the gripping handle pulling cable 13 upwardly, and through the springs and camming mechanisms shown in FIGS. 5-9, the third stage tube 18 can begin manual movement upwardly until locking pin 25 of locking mechanism 23 enters aperture 35 of second stage tube 16.

Thereafter second stage tube 16 is pulled upwardly with third stage tube 18 until metal locking pin 33 of lower locking mechanism 21 enters aperture 32 of metal strip 30, such that the telescoping handle is in the fully extended condition. Metal strips 28, 30 each have more than one optional aperture to provide for fine adjustments, if needed.

By depressing button 17, the locking pins 25, 33 are withdrawn respectively from their apertures via the button operated ramming and spring mechanism shown, thereby permitting the operator to manually collapse the three stage handle to the condition shown in FIG. 1.

It can be appreciated that the first stage telescopic tube of the present invention, reinforced by metal strips 30, 36, makes it possible to provide a lighter weight first stage tube, combined with greater strength for carrying substantially the entire load of the telescopic system through the unique combination of the extruded plastic tube and the metal strips which are retained in position by the radially inwardly extending flanges which are molded monolithically with the first stage tubes. This feature provides a significant increase in strength, combined with a correspondingly significant decrease in weight, without loss of esthetics.

Furthermore, the extruded tubes can be molded to any length and cut to size to custom fit any particular size carry case without the need to produce customized molds. The metal strips can similarly be cut to size to fit any size carry case. In addition, the unique first stage tubes of the present invention can also be incorporated into telescopic handles comprised of alternative number of stages, i.e., 2 stage, 4 stage, etc.

The present invention can also be used with individually molded tubes, or tubes of any material requiring strength enhancement. However, it is best configured for use with extruded first stage tubes.

The invention claimed is:

1. A trolley-type carry case having a three stage telescopic handle system, which comprises:

a) a container for reception and retention of selected articles; and b) a telescopic handle system attached to said container, which comprises:

at least a first stage extruded plastic tubular member, said extruded plastic tubular member defining a generally central tubular opening having an inner tubular surface, said extruded plastic tubular member having a pair of generally opposed reinforcement strips made of a material of strength greater than the material of said tubular member positioned on said inner tubular surface of said central tubular opening, each said reinforcement strip having a generally radially extending retention member positioned along each side and offset to form a generally hat-like cross-sectional shape, said retention member configured to retain said reinforcement strip in position adjacent the inner surface of said tubular member, each said reinforcement strip having a plurality of apertures of predetermined size and relative locations for reception of spring biased pins associated with a respective second and third stage members of said telescoping handle system.

2. A tube for a first stage of a telescopic handle system for a trolley-type carry case, which comprises:

a) an elongated tubular member;

b) at least a pair of opposed radially inwardly extending members extending from the inner surface of said tubular member, each said radially inwardly extending member being comprised of a generally circumferential flange member extending from the free end thereof and each said flange member facing the other so as to form a pair of opposed flange members which define a space therebetween for reception of an elongated reinforcement strip; and c) at least one elongated reinforcement strip positioned between said flange members and retained in position against the inner surface of said elongated tubular member, said elongated reinforcement strip being of a material which adds strength to the said elongated tubular member, said elongated reinforcement strip having a plurality of apertures dimensionally and relatively spaced for reception of spring biased locking pins associated with a locking device for retaining respective associated stages of a telescopic handle in either the withdrawn or the extended position when said pins enter predetermined respective apertures in said reinforcement strip.

3. A telescopic handle assembly for a trolley-type carry case, comprising:

a first stage tubular member, said generally tubular member being made of an extruded plastic material and defining a generally central elongated tubular opening;

a pair of opposed reinforcement strips held within said generally tubular opening of said first stage tubular member, said reinforcement strips dimensioned to extend generally along a length of said first stage tubular member thereof, said reinforcement strips being of a material of strength generally greater than the strength of the material of said first stage tubular member, each said reinforcement strip having a plurality of apertures of predetermined size and relative positions for respective reception of spring biased pins associated with respective second and third stage sections of the telescopic handle assembly for respective retention of the handle assembly in the respective collapsed and extended positions; and retaining members positioned within said generally tubular opening and along the length of said first stage tubular member, said retaining members formed of at least a pair of opposed radially inwardly extending members extending from an inner surface of said first stage tubular member, each said radially inwardly extending member having a generally circumferential flange member extending from the free end thereof and each said flange member facing the other so as to form a pair of opposed flange members which define a space therebetween for reception and retention of each said reinforcement strip.

4. The telescopic handle assembly according to claim 3, wherein said extruded plastic tubular member comprises a plurality of radial plastic ribs extending inwardly of said inner surface to provide structural support to said tubular member.

5. The telescopic handle assembly according to claim 4, wherein said handle system comprises a pair of said first stage tubular members.

6. The telescopic handle assembly according to claim 5, wherein a locking system is provided to extend and lock second and third stage sections in selected portions.

7. The telescopic handle assembly according to claim 6, wherein the third stage tubes are connected by a gripping handle and said locking system includes a release button in said gripping handle, said release button connected to respective cables and spring biased pins adapted to selectively lock and release the second and third stage tubes in selected positions.

8. The telescopic handle assembly according to claim 7, wherein said second and third stage tubes are aluminum.

9. The telescopic handle assembly according to claim 8, wherein each said tubular member is polyvinyl chloride and said reinforcement strips are aluminum.

10. A telescopic handle system for a trolley-type carry-case, comprising:

at least a first stage extruded plastic tubular member, said extruded plastic tubular member defining a generally central tubular opening having an inner tubular surface;

a pair of generally opposed reinforcement strips made of a material of strength greater than the material of said tubular member, said pair of generally opposed reinforcement strips being positioned on said inner tubular surface of said central tubular opening, each said reinforcement strip having a generally radially extending retention member positioned along each side and offset to form a generally hat-like cross-sectional shape, said retention member configured to retain said reinforcement strip in position on the inner surface of said tubular member, each said reinforcement strip having a plurality of apertures of predetermined size and relative locations for selective reception of spring biased pins associated with a respective second and third stage members of said telescoping handle system.

11. A tubular member for the first stage of a telescopic handle system for a trolley-type carry case, which comprises:

a) a generally elongated tubular member made of an extruded plastic material and having a generally central elongated opening; and b) a plurality of radially inwardly extending members which are coextruded with said generally tubular member, at least certain of said radially inwardly extended members providing reinforcement to said extruded tubular member against forces applied thereto during use, at least certain of said radially inwardly extending members having generally opposed circumferential members at the radially inwardmost free end thereof and facing each other to form a pair of flanges which respectively overlay at least a marginal portion of a respective reinforcement member to retain said respective reinforcement member in position within said generally central opening, said respective reinforcement member having a plurality of apertures of predetermined size and relatively spaced positions for reception of spring-biased pins associated with a release and locking mechanism for a multi-stage telescopic handle system.

12. The trolley-type carry case according to claim 1, wherein said container is an article of luggage.

* * * * *